United States Patent [19]

Hansen

[11] 3,935,577

[45] Jan. 27, 1976

[54] FLARED MICROWAVE HORN WITH DIELECTRIC LENS

[75] Inventor: Laurence H. Hansen, Oak Lawn, Ill.

[73] Assignee: Andrew Corporation, Orland Park, Ill.

[22] Filed: Sept. 11, 1974

[21] Appl. No.: 504,967

[52] U.S. Cl. ..... 343/781; 343/783

[51] Int. Cl.[2] ..... H01Q 13/06

[58] Field of Search ..... 343/753, 783, 784, 785, 343/786, 781

[56] References Cited

UNITED STATES PATENTS

| | | | |
|---|---|---|---|
| 2,588,610 | 3/1952 | Boothroyd et al. | 343/753 |
| 2,719,230 | 9/1955 | Smoll et al. | 343/783 |
| 3,099,836 | 7/1963 | Carr | 343/753 |
| 3,329,958 | 7/1967 | Anderson | 343/753 |
| 3,750,182 | 7/1973 | Kernucis | 343/783 |

*Primary Examiner*—Eli Lieberman

*Attorney, Agent, or Firm*—Wolfe, Hubbard, Leydig, Voit & Osann, Ltd.

[57] ABSTRACT

A dielectric lens for a flared microwave horn, the lens correcting the phase error introduced in microwaves passing through the horn. The lens comprises a plurality of parallel dielectric discs disposed concentrically with the horn in the path of microwaves passing through the horn. The disc have different diameters so that different portions of the microwaves pass through different numbers of the discs to compensate for the phase error introduced by the flared horn. The impedance discontinuities of the discs are matched out by appropriate spacing of the discs. The discs are preferably flat sheets of dielectric material so that they are easy to fabricate, and they are preferably supported by a central axial support means to minimize interference with microwaves passing through the discs. The number, thickness and diameters of the discs may be selected to produce substantially zero phase error in any given flared horn.

5 Claims, 6 Drawing Figures

FLARED MICROWAVE HORN WITH DIELECTRIC LENS

DESCRIPTION OF THE INVENTION

The present invention relates generally to microwave horns and, more particularly, to an improved dielectric lens for correcting the phase error caused by a flared microwave horn.

Flared microwave horns are normally used as "feed" horns for microwave antennas, such as parabolic dish-type antennas. Although such a horn is commonly referred to as a "feed" horn, it obviously functions as a part of the antenna system in both the sending and receiving modes. Not all waveguide horns are flared, but the use of flared horns is often desired to achieve specific advantages, such as pattern shaping and attaining a closer match between the impedance of the horn and the characteristic impedance of free space.

One of the problems inherent in a flared microwave horn is that the path length from one end of the horn to the other gradually increases between the center of the horn and its outer walls. That is, the path followed by the microwaves is shorter along the axis of the flared horn than along the walls of the horn. The differing lengths of these transmission paths introduces a phase error in microwaves passed through the horn. One way to minimize this phase error is to simply use a long horn so that the difference in the lengths of the transmission paths through the horn is small in relation to the total length of the horn. However, this is not always a practical solution to the problem because increasing the length of the horn naturally increases its cost as well as requiring a stronger and more expensive supporting structure, and it can lead to problems in positioning the horn properly in relation to the other components of the antenna system.

Another known solution to the phase error problem is to introduce a convex dielectric lens in the path of the microwaves. The variation in axial thickness along the radius of the convex lens compensates for the phase error introduced by the flared horn. However, when one attempts to design and fabricate a dielectric lens for a particular feed horn, a number of practical problems are encountered. For example, a lens introduces an impedance discontinuity which is normally "tuned out" by coating the lens with a dissimilar dielectric material that introduces an impedance matching transformer, matching the discontinuity introduced by the lens. However, available dielectric materials offer such a limited range of dielectric constants that it is often difficult to select dielectric materials that will achieve both impedance matching and phase correction for a given horn. Furthermore, existing dielectric materials are often difficult to shape into the desired lens configuration, and they are also often lacking in homogeneity. Consequently, the use of a convex lens is often not a very practical solution to the phase error problem introduced by a flared horn.

Another type of lens used heretofore is a stepped lens that approximates the smooth convex lens discussed above. Whereas a convex lens provides continuous phase error correction, a stepped lens provides discrete amounts of correction. The more steps used, the closer the approximation of the stepped lens approaches the convex lens. However, the stepped lens suffers from the same disadvantages discussed above for the convex lens.

It is, therefore, a primary object of the present invention to provide a dielectric lens which is capable of achieving correction of phase error while introducing only a small impedance discontinuity in a wide variety of different flared microwave horns. Thus, it is an object of this invention to provide such a dielectric lens which can achieve the desired phase correction with a minimum of impedance discontiniuty in flared horns of varying length, varying diameter, and varying degrees of flare.

Another important object of the present invention is to provide an improved dielectric lens of the type described above which permits the use of virtually any desired dielectric material, independently of the phase error and impedance discontinuity problems presented by any given horn. In this connection, a related object of the invention is to provide such an improved dielectric lens which permits the use of highly reliable (uniform dielectric constant) dielectric material having known characteristics, regardless of the specific phase error and impedance matching problems presented by any given horn.

Another object of the invention is to provide an improved dielectric lens of the foregoing type which does not pose any problem of shaping the dielectric material, and which avoids the problems presented by the lack of homogeneity in many dielectric materials.

Yet another object of the invention is to provide such an improved dielectric lens which can be easily and quickly fabricated at a low cost.

Other objects and advantages of the invention will be apparent from the following detailed description and the accompanying drawings, in which.

While the invention will be described in connection with certain preferred embodiments, it will be understood that it is not intended to limit the invention to those particular embodiments. On the contrary, it is intended to cover all alternatives, modifications and equivalents as may be included within the spirit and scope of the invention as defined by the appended claims.

Figure 1:
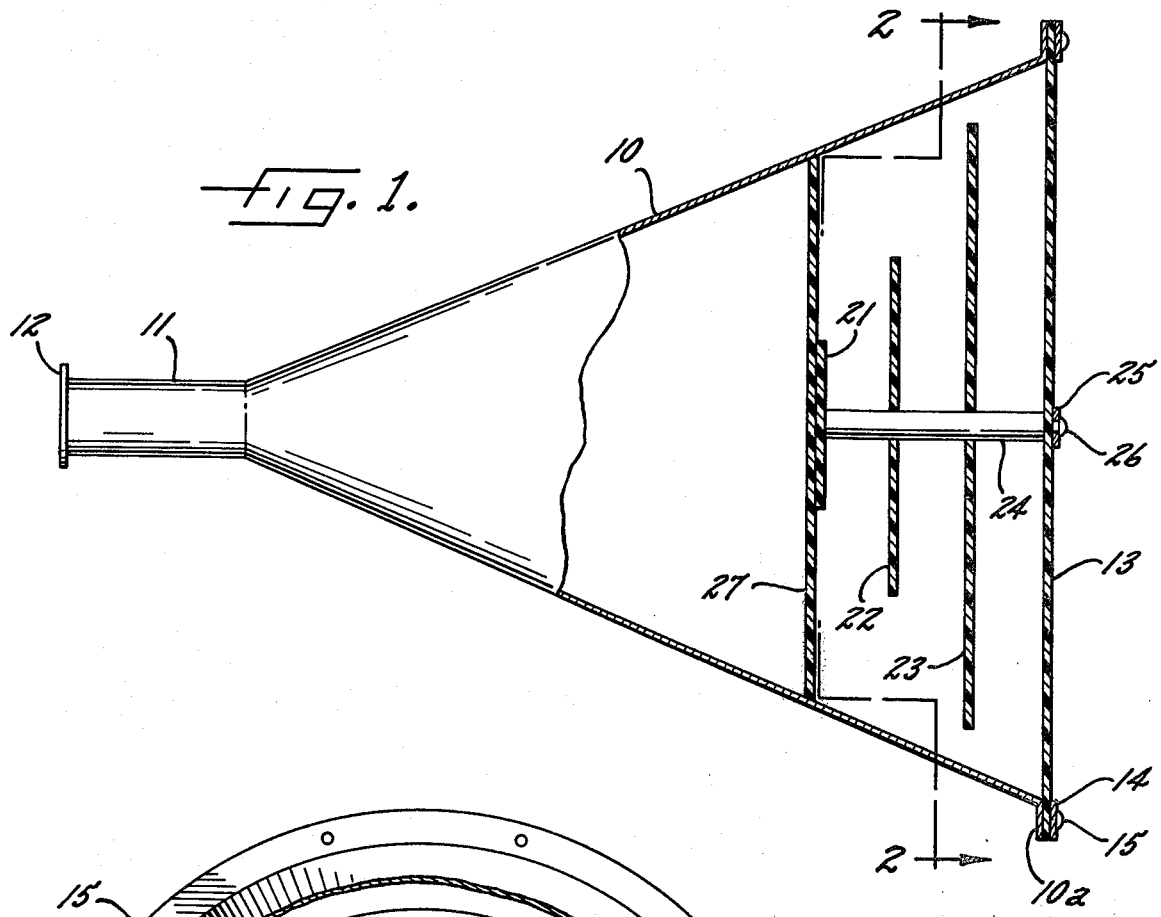
FIG. 1 is a side elevation, partially in section, of a flared microwave horn containing a dielectric lens embodying the invention.
Figure 2:
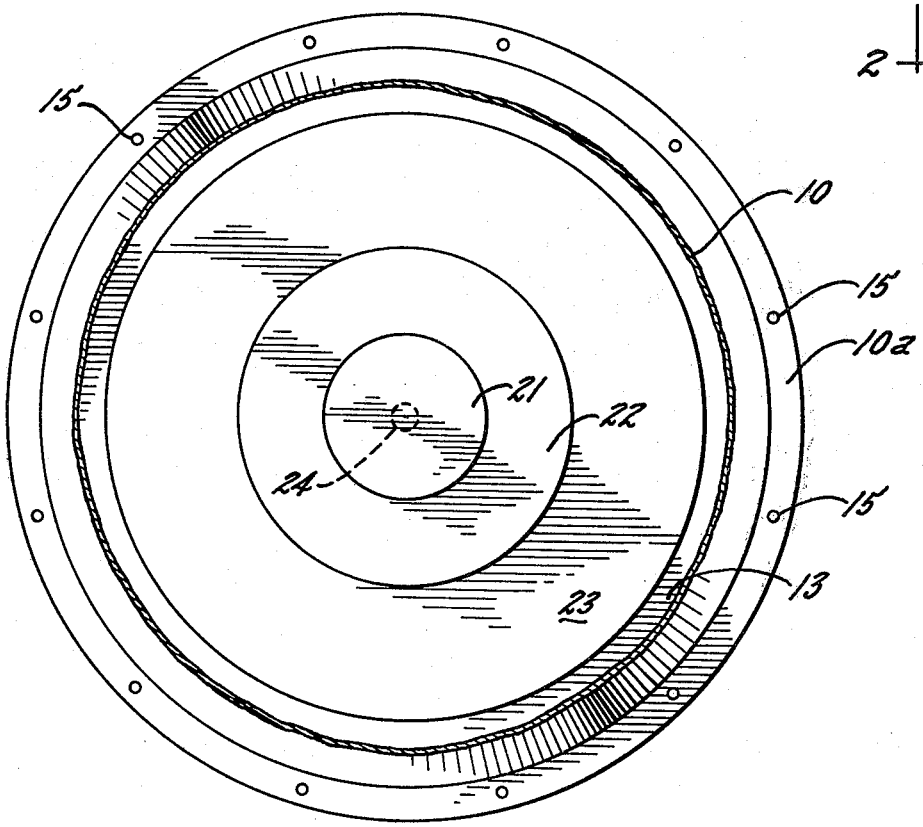
FIG. 2 is a section taken along line 2–2 in FIG. 1.

Turning now to the drawings and referring first to FIGS. 1 and 2, there is shown a flared microwave horn 10 of frustroconical shape. The small end of the horn 10 is connected to a circular waveguide 11 having a flanged end 12 for connecting the waveguide 11 and horn 10 to a cooperating waveguide or waveguide transition for transimtting signals to and from the horn. The large end of the horn 10 is covered by a window 13 secured to a peripheral flange **10*a* on the horn by means of a retaining ring 14 and a plurality of screws 15** threaded into the horn flange 10*a*. This window 13 is typically a flat sheet of acrylic such as "Plexiglas" having a substantial degree of rigidity, e.g., with a thickness of 0.062 inch.

In accordance with one important aspect of the present invention, there is provided a dielectric lens which comprises a plurality of parallel dielectric discs disposed concentrically with the feed horn in the path of microwaves passing through the horn. The discs have different diameters so that different portions of the microwaves passing through the horn pass through different numbers of the discs to compensate for the phase error introduced by the flared horn, and the discs are spaced apart so that the impedance discontinuities of the discs are substantially matched. Thus, in the particular embodiment illustrated in FIGS. 1 and 2, the dielectric lens comprises three discs 21, 22 and 23 mounted at equally spaced intervals near the large end of the flared horn 10. The three discs all have different diameters so that portions of the microwaves passing through the space occupied by the smallest disc 21, which is the shortest path between opposite ends of the horn, must pass through all three discs 21, 22 and 23 in order to travel from one end of the horn to the other. Those portions of the microwaves passing through the annular region between the outer peripheries of the smallest disc 21 and the intermediate disc 22 must pass through only the two discs 22 and 23; those portions of the microwaves passing through the annular region between the outer peripheries of the intermediate disc 22 and the largest disc 23 must pass through only the single disc 23; and those portions of the microwaves passing through the annular region between the periphery of the largest disc 23 and the wall of the horn, which is the largest path through the horn, do not pass through any of the discs.

This arrangement of multiple discs is extremely versatile and can be used to correct the phase error in virtually any type of flared horn, regardless of its specific configuration and dimensions. Thus, to tailor the lens system to any particular horn, the number of discs, the disc thickness and/or the disc diameter may be varied. By proper selection and adjustment of these variables, the phase error introduced by the flared horn can be corrected just as effectively as by the use of a curved lens, but much more easily because of the ease of fabricating the flat discs 21, 22 and 23.

Moreover, with the multiple discs matching of impedance discontinuities can be achieved by simply spacing the discs so that microwave reflections from the discs cancel out each other. This match can be easily achieved even when all the discs are made of the same dielectric material, so it is not necessary to use more than one type of dielectric material. On the other hand, if desired, the discs may be made from dissimilar dielectric materials and the spaces between adjacent discs adjusted accordingly to achieve cancellation of impedance discontinuities. The optimum spacings of the respective discs may be calculated by a technique similar to that used to calculate the optimum spacing between layers of a conventional multilayer resonant radome, as described, for example, in *Antenna Engineering Handbook* by Henry Jasik, (McGraw-Hill) pages 32-23 to 32-28. Multilayer resonant radomes, of course, do not compensate for phase error.

Another significant advantage of the lens structure provided by this invention is the facility with which it can be fabricated and assembled. Fabrication merely involves cutting the circular dielectric discs 21, 22 and 23 out of flat sheet stock and mounting the discs on a suitable support rod 24 fastened to the window 13 by means of a washer 25 and screw 26. The discs 21, 22 and 23 may be mounted on the rod 24 by means of adhesive or other suitable fastening means. In the particular embodiment illustrated, additional stability of the lens structure is provided by an additional disc 27 secured to the smallest disc 21 and to the walls of the horn. This disc 27, which may be made of the same material as the window 13, extends continuously across the full width of the horn, so it does not have any effect on phase error. If desired, the largest disc 23 can be fastened directly to the window 13. Another alternative mounting arrangement is to fasten the outer peripheries of the discs to each other by means of axially extending flanges or rims, although the illustrated center axial support is preferred to minimize interference with microwaves passing through the horn.

One of the advantages of the use of flat sheets of dielectric material is that this is the form in which dielectric material can be most reliably controlled during manufacture. Thus, in addition to facilitating manufacture of the lens, the use of the flat discs permits utilization of the most reliable type of dielectric material that is available at a reasonable cost.

Although the invention has been illustrated as comprising three discs, it will be understood that virtually any desired number of discs may be employed to achieve the desired result with any particular horn. The greater the number of discs employed, the closer the lens approximates a convex lens. The number of discs required in any given horn depends on the specific application. Also, the discs may be made of different materials if desired, provided the discs are spaced so as to achieve cancellation of impedance discontinuities. If desired, discs of two or more dissimilar materials may be arranged in contact with each other so that the space between a given pair of discs of similar material is filled with one or more discs of dissimilar material.

The location of the lens relative to the horn is not critical. Although the location shown offers the advantages of ease of mounting and protection from weather, the lens can be positioned closer to the small end of the horn if desired. Alternatively, the lens can even be located outside the horn, directly in front of the window 13.

In order to compare the performance of a flared horn with and without the lens of this invention, a frustoconical horn 24 inches long with an inside diameter of 2.094 inches at the small end and 10 inches at the large end was tested at a frequency of 6.175 GHz. In one test the horn had no lens. In the other test the horn was provided with a lens comprising four acrylic ("Plexiglas") discs ⅛ inch thick with diameters of 8⅜ inches, 6¾ inches, 6¼ inches and 4 inches. The largest disc was mounted against the horn window, and the spacings between the discs were 0.259 inch between each end disc and the disc adjacent thereto, and 0.960 inch between the two middle discs. These spacings were calculated for operation at frequency bands of 3.7 to 4.2 GHz and 5.925 to 6.425 GHz, using conventional techniques for calculating the spacing between layers of multilayer resonant radomes as described in *Antenna Engineering Hardbook* by Henry Jasik, pages 32-23 to 32-28. The total combination of spacings was not optimum for either frequency band by itself, but represented a compromise for near-optimum operation at both frequency bands. All the discs were mounted on a central ¼ inch dielectric rod fastened at one end to the horn window.

Figure 3:
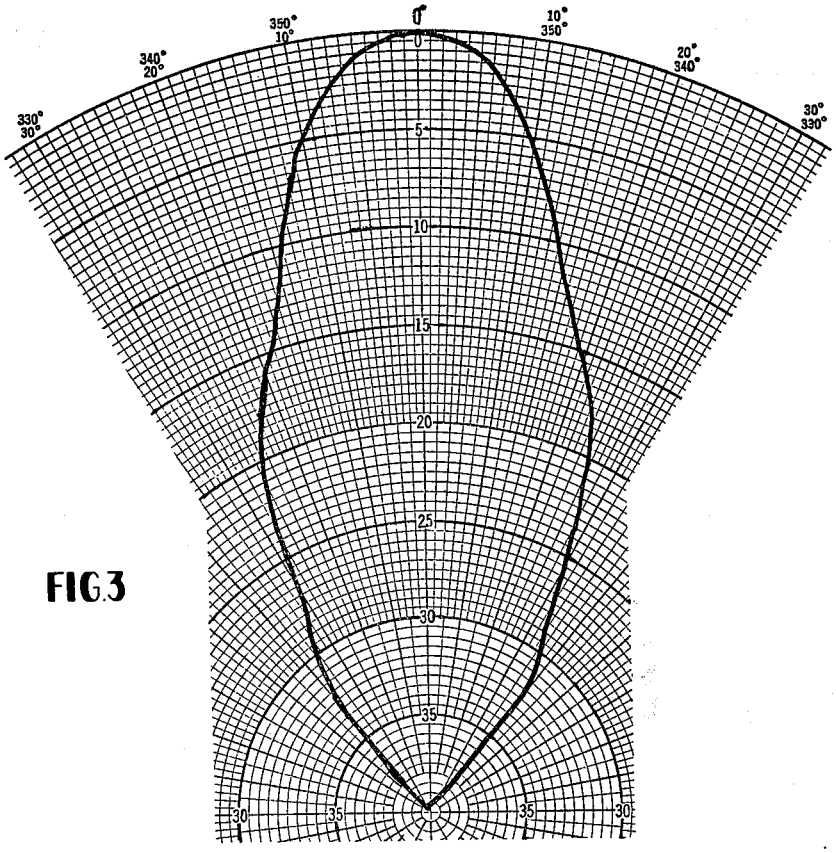
FIG. 3 is an actual radiation pattern obtained with a flared horn without a lens.
Figure 4:
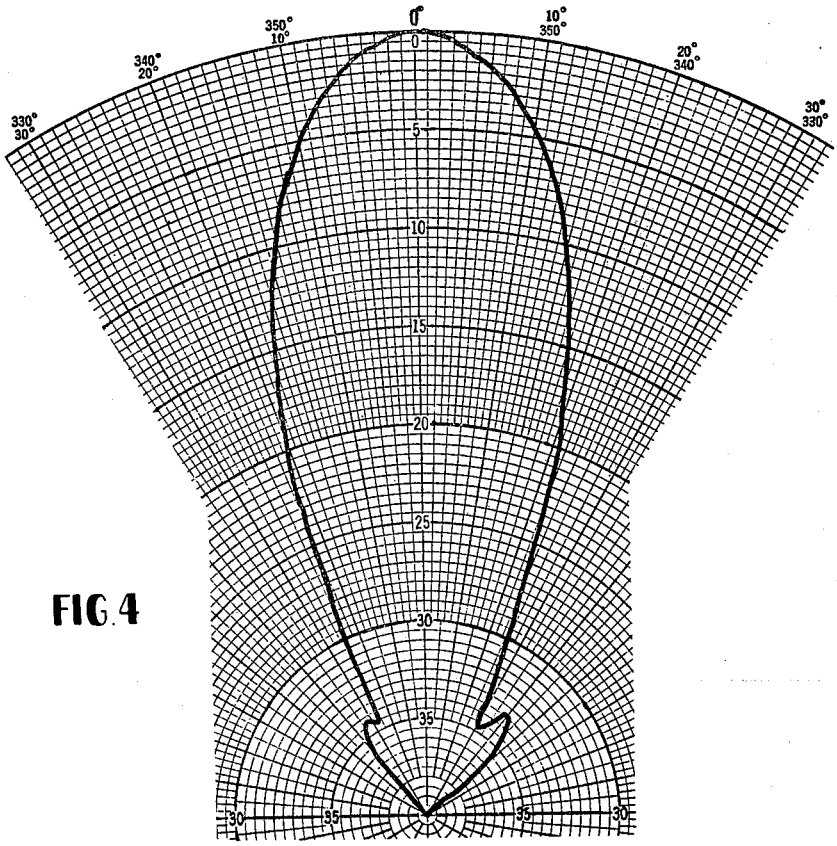
FIG. 4 is an actual radiation pattern obtained with the same horn that produced the pattern of FIG. 3 after addition of a lens embodying the invention.

Radiation patterns generated by the horn, both with and without the lens, were recorded at an operating frequency of 6.175 GHz in an anechoic chamber. The resulting H-plane radiation patterns, made on a pattern recorder, are shown in FIGS. 3 and 4, FIG. 3 showing the pattern obtained without the lens and FIG. 4 showing the pattern obtained with the lens. The pattern of FIG. 3 is not smooth and the side lobes are smeared into the main beam, both of which are characteristics indicating phase error. In contrast, the pattern of FIG. 4 is much smoother with two distinct side lobes, indicating negligible phase error.

The reflection coefficients of the same horn, with and without the lens, were also measured in the frequency band between 5.925 and 6.425 GHz. When the reflection coefficient characteristic of the horn with the lens matches that of the horn without the lens, the impedance discontinuities introduced by the lens are cancelled. The reflection coefficient measurements were made using a hybrid tee (rectangular configuration) with a directivity of better than 60 dB, which is required to measure the very low reflection coefficients of the horn. A conventional waveguide transition was used between the circular waveguide attached to the horn and the rectangular hybrid tee.

Figure 5:
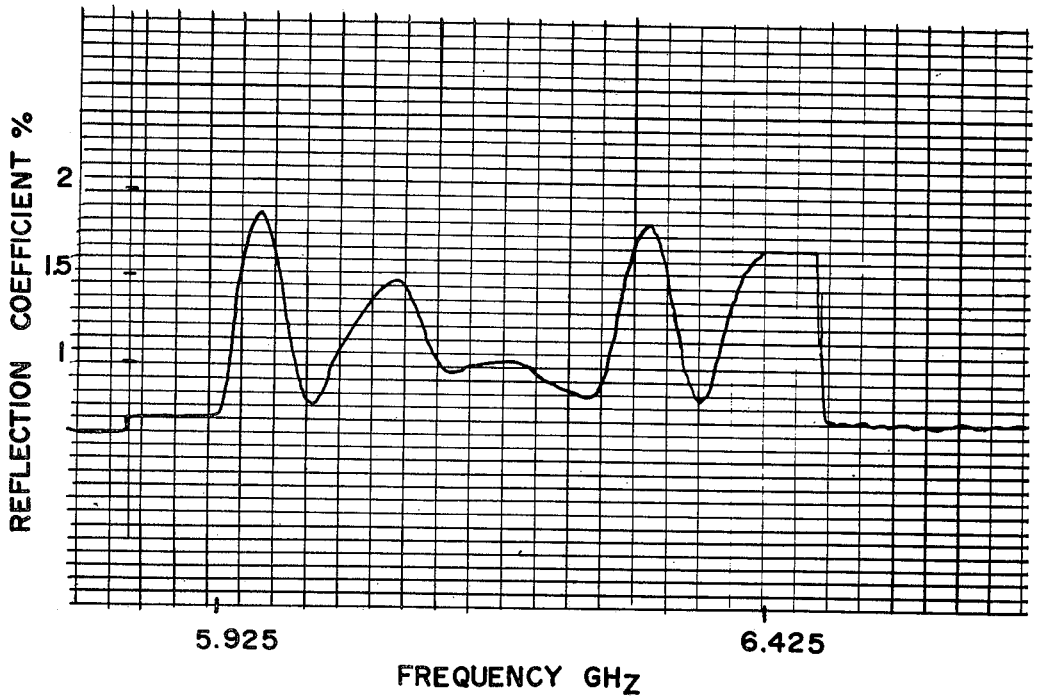
FIG. 5 is a record of the reflection coefficients measured for the horn that produced the pattern of FIG. 3 in the indicated frequency band.
Figure 6:
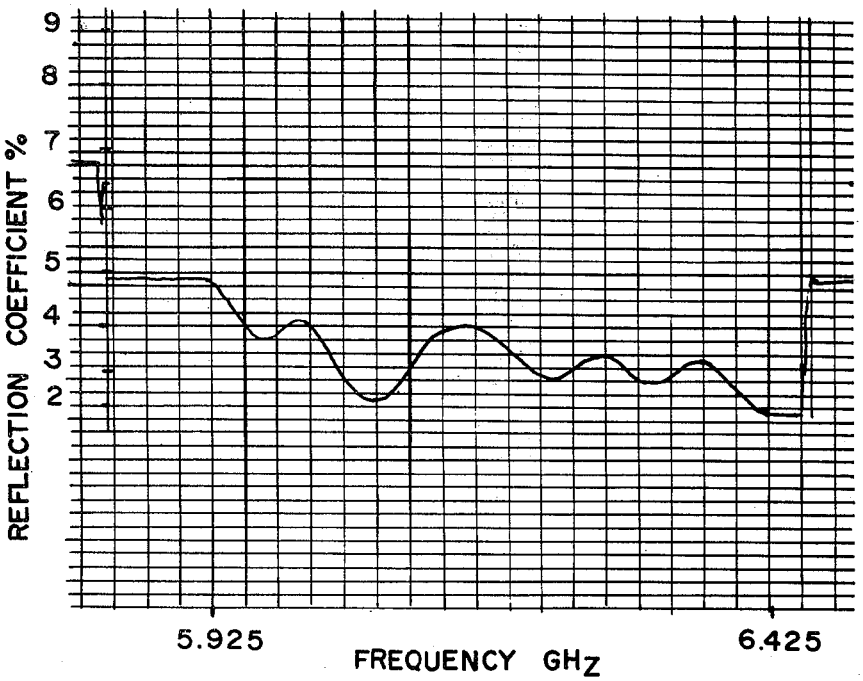
FIG. 6 is a record of the reflection coefficients measured for the horn and lens that produced the pattern of FIG. 4 in the indicated frequency band.

The measured values of the reflection coefficient are shown in FIGS. 5 and 6, FIG. 5 showing the values obtained without the lens and FIG. 6 showing the values obtained with the lens. As can be seen from the curves in these figures, the maximum value of the coefficient without the lens was 1.9%. With the lens, the coefficient ranged from about 2% to about 4.9%. The overall curve in FIG. 6 indicates that the reflection coefficient was about 3%, which compares with a reflection coefficient of about 10% for a conventional convex lens (without a corrective coating).

As used herein, the term "discs" is intended to include peripheral configurations other than circular. For example, when the lens is used in a square horn, the discs would obviously have the same square peripheral shape as the horn.

1. In a feed horn for a dish-type microwave antenna, the combination of a flared microwave horn that introduces a phase error in microwaves passing therethrough, and a dielectric lens comprising a plurality of parallel dielectric discs disposed concentrically with said horn in the path of microwaves passing through said horn, said discs being located within said horn so that the beam width of the microwaves radiated from the horn is substantially unaffected by the discs, said discs having different diameters so that different portions of the microwaves pass through different numbers of said discs to compensate for the phase error introduced by the flared horn independently of the beam width, said disc being spaced apart so that the impedance discontinuities of the discs are substantially cancelled.

2. The combination of claim 1 wherein each of said discs is a flat sheet of dielectric material.

3. The combination of claim 1 wherein said discs are made of similar dielectric material.

4. The combination of claim 1 wherein said discs are all supported by central axial support means to minimize interference with the microwaves passing through said discs.

5. In a feed horn for a dish-type microwave antenna, the combination of a flared microwave horn that introduces a phase error in microwaves passing therethrough, and a dielectric lens comprising a plurality of parallel dielectric discs disposed concentrically with said horn in the path of microwaves passing said horn, said discs being located within said horn so that the beam width of the microwaves radiated from the horn is substantially unaffected by the discs, said discs having different diameters so that different portions of the microwaves pass through different numbers of said discs to compensate for the phase error introduced by the flared horn independently of the beam width, discs of similar dielectric material being spaced apart so that the impedance discontinuities of such discs are substantially cancelled.

* * * * *